US005951714A

United States Patent [19]

Hall et al.

[11] Patent Number: 5,951,714

[45] Date of Patent: Sep. 14, 1999

[54] ENZYMATIC DISCHARGE PRINTING OF DYED TEXTILES

[75] Inventors: Gregory K. Hall, Woodbury, Minn.; Charles W. Stewart; Garrett A. Screws, both of Raleigh, N.C.

[73] Assignee: Novo Nordisk Biochem North America, Inc., Franklinton, N.C.

[21] Appl. No.: 09/048,437

[22] Filed: Mar. 26, 1998

Related U.S. Application Data

[60] Provisional application No. 60/061,001, Apr. 17, 1997.

[51] Int. Cl.[6] ..... D06M 15/15; D06L 3/02; C12S 11/00

[52] U.S. Cl. ..... 8/102; 8/101; 8/107; 8/111; 8/114; 8/115; 8/401; 435/263; 101/483; 101/487; 101/488; 101/494

[58] Field of Search ..... 8/102, 101, 107, 8/111, 114, 115, 401; 435/263; 101/483, 487, 488, 494

[56] References Cited

U.S. PATENT DOCUMENTS

| | | | |
|---|---|---|---|
| 4,247,295 | 1/1981 | Paxtot | 8/465 |
| 5,593,458 | 1/1997 | Dickson et al. | 8/102 |

FOREIGN PATENT DOCUMENTS

| | | |
|---|---|---|
| WO 92/18683 | 10/1992 | WIPO . |
| WO 96/12845 | 5/1996 | WIPO . |
| WO 96/12846 | 5/1996 | WIPO . |

OTHER PUBLICATIONS

Abstract, Database WPI, Section Ch, Week 9612, Derwent Publications Ltd., London, GB; Class D16 AN 96–113298, XP002069735 & JP 08 013 360 A (Osaka Prefecture). Jan. 16, 1996.

*Primary Examiner*—Alan Diamond

*Attorney, Agent, or Firm*—Steve T. Zelson, Esq.; Reza Green, Esq.

[57] ABSTRACT

A process for enzymatic discharge printing of the surface of dyed fabric, especially cellulosic fabric such as denim, including an oxidoreductase and enhancing agent system.

20 Claims, No Drawings

ENZYMATIC DISCHARGE PRINTING OF DYED TEXTILES

CROSS-REFERENCE TO RELATED APPLICATIONS

This application claims the benefit under 35 U.S.C. 119 of provisional application Ser. No. 60/061,001 filed Apr. 17, 1997, the contents of which are fully incorporated herein by reference.

FIELD OF THE INVENTION

The present invention relates to a process for enzymatic discharge printing of the surface of dyed fabric, especially cellulosic fabric such as denim.

BACKGROUND OF THE INVENTION

Bleaching enzymes such as peroxidases together with hydrogen peroxide or oxidases together with oxygen have also been suggested for bleaching of dyed textiles (see WO 92/18683), either alone or together with a phenol such as p-hydroxycinnamic acid, 2,4-dichlorophenol, p-hydroxybenzene sulphonate, vanillin or p-hydroxybenzoic acid.

Dyeing of textiles is often considered to be the most important and expensive single step in the manufacturing of textile fabrics and garments. The major classes of dyes are azo (mono-, di-, tri-, etc.), carbonyl (anthraquinone and indigo derivatives), cyanine, di- and triphenylmethane and phthalocyanine. All these dyes contain chromophoric groups which give rise to color. There are three types of dyes involving an oxidation/reduction mechanism, i.e., vat, sulfur and azoic dyes. The purpose of the oxidation/reduction step in these dyeings are to change the dyestuff between an insoluble and a soluble form.

Oxidoreductases, e.g., oxidases and peroxidases, are well known in the art. WO 91/05839 discloses that oxidases and peroxidases are useful for inhibiting the transfer of textile dyes. One class of oxidoreductases is laccases (benzenediol:oxygen oxidoreductases) which are multi-copper containing enzymes that catalyze the oxidation of phenols and related compounds. Laccase-mediated oxidation results in the production of aromatic radical intermediates from suitable substrates; the ultimate coupling of the intermediates so produced provides a combination of dimeric, oligomeric, and polymeric reaction products. Such reactions are important in nature in biosynthetic pathways which lead to the formation of melanin, alkaloids, toxins, lignins, and humic acids. Another class of oxidoreductases are peroxidases which oxidize compounds in the presence of hydrogen peroxide. Saunders et al., *Peroxidase*, London, 1964, p. 10 ff. disclose that peroxidases act on various amino and phenolic compounds resulting in the production of a color.

Laccases have been found to be useful for hair dyeing. See, e.g., PCT applications Ser. No. PCT/US95/06815 and PCT/US95/06816. European Patent No. 0504005 discloses that laccases can be used for dyeing wool at a pH in the range of between 6.5 and 8.0.

Japanese Patent Application publication no. 6-316874 discloses a method for dyeing cotton comprising treating the cotton with an oxygen-containing medium, wherein an oxidation reduction enzyme selected from the group consisting of ascorbate oxidase, bilirubin oxidase, catalase, laccase, peroxidase, and polyphenol oxidase is used to generate the oxygen.

Discharge printing is a method of obtaining printed images on a fabric surface by selectively removing dye from a dyed fabric. For example, indigo dye can be discharged by transforming the indigo into yellow, water-soluble stain by oxidation or by reforming leuco-indigo which can be readily removed from fiber by alkali treatment. Generally, three methods of oxidation discharge printing are used commercially: chromate, chlorate, and prussiate discharge.

Reduction discharge of indigo dyeings is based on the reducing action of hydrosulfite on vat dyes and is carried out in the same manner by printing discharge paste on the fabric, aging the printed fabric, and exposing the printed fabric to a caustic soda or sodium silicate bath in order to dissolve the reduced indigo from the printed parts of the fabric. Of commercial importance is the use of hydrosulfite discharge of indigo.

BRIEF SUMMARY OF THE INVENTION

The invention features an enzymatic method of discharge printing by contacting a dyed fabric with a phenol oxidizing enzyme system and an enhancing agent such that dye is selectively discharged from the fabric at selected areas, creating a printed surface. Unique printing shades can be imparted to the printed areas when substrates are dyed with two or more dyes differing in sensitivity to reduction/oxidation, e.g., indigo and sulfur black dyed warp yarns in a denim fabric.

The method of the invention requires both the presence of the phenol oxidizing enzyme system and an enhancing agent for dye discharge. Accordingly, in one embodiment, the enzyme and enhancing agent are combined in a product, e.g., a paste, and applied together to the dyed fabric in the areas to be decolored.

In a second embodiment, an enhancing agent is first applied to the dyed fabric, followed by a separate application of a product, e.g., paste, containing the enzyme system. Contact of the enzyme system with the enhancing agent initiates dye discharge.

In a related embodiment, the enzyme system is first applied to the dyed fabric, followed by a separate application of a product, e.g., paste, containing an enhancing agent.

In one aspect, the invention is a method for enzymatic discharge printing, comprising contacting a dyed fabric substrate with a phenol oxidizing enzyme system and enhancing agent under conditions in which dye is removed from one or more selected areas of the surface of the fabric.

The method of the invention may be used with a variety of fabrics, including a cellulosic fabric, a mixture of cellulosic fibres, or a mixture of cellulosic fibres and synthetic fibres. Suitable fabrics include cotton, cotton denim, polyester, spandex, silk, wool, cellulosic fibers, or a mixture thereof.

The fabric may be dyed by one or more dyes or colorants known to the art, including, for example, indigo or indigo-related dyes.

The method includes a phenol oxiding enzyme is selected from the group consisting of peroxidase, laccase, chatechol oxidase, bilirubin oxidase, and monophenol monooxygenase. Suitable enhancing agents include 2-(p-aminophenyl)-6-methylbenzothiazole-7-sulfonic acid, N-(4-(dimethylamino)benzylidene)-p-anisidine, 3-methyl-2-benzothiazolinone(4-(dimethylamino)benzylidene) hydrazone, vanillin azine, 4-amino-4'-methoxystilbene, 4,4'-diaminostilbene-2,2'-disulfonic acid, iminostilbene, 4,4'-dihydroxybenzophenone, N-benzylidene-4-biphenylamine, 4,4'-diaminodiphenylamine, 4,4'-dimethoxy-N-methyldiphenylamine, 2,7-diaminofluorene, triphenylamine, 10-methylphenothiazine, 10-phenothiazine-propionic acid, N-hydroxysuccinimide-10-phenothiazine-propionate or 10-ethyl-4-phenothiazine-carboxylic acid, 10-ethylphenothiazine, 10-propylphenothiazine, 10-isopropylphenothiazine, methyl-10-phenothiazinepropionate, 10-phenylphenothiazine, 10-allylphenothiazine, 10-(3-(4-methyl-1-piperazinyl) propyl)phenothiazine, 10-(2-pyrrolidinoethyl) phenothiazine, 2-acetyl-10-methylphenothiazine, 4-carboxy-10-phenothiazine, 10-methylphenoxazine, 10-ethylphenoxazine, 10-phenoxazine-propionic acid, 4-carboxy-10-phenoxazine-propionic acid, 10-(2-hydroxyethyl)phenothiazine, 10-(2-hydroxyethyl) phenoxazine or 10-(3-hydroxypropyl)phenothiazine; benzidine, 3,3'-dimethylbenzidine, 3,3'-dimethoxybenzidine, 3,3',5,5'-tetramethylbenzidine, 4'-hydroxy-4-biphenylcarboxylic acid, or 4,4'-dihydroxybiphenylene; 6-hydroxy-2-naphtoic acid, 7-methoxy-2-naphtol, 7-amino-2-naphthalene sulfonic acid, 5-amino-2-naphthalene sulfonic acid, 1,5-diaminonaphthalene, 7-hydroxy-1,2-naphthimidazole, 5-amino-2-naphthalenesulfonic acid, or 7-methoxy-2-naphtol; acetosyringone, methylsyringate, ethylsyringate, propylsyringate, butylsyringate, hexylsyringate, or octylsyringate.

In a specific embodiment, the phenol oxidizing enzyme system comprises peroxidase and a source of hydrogen peroxide. In another specific embodiment, the phenol oxidizing enzyme system and enhancing agent comprise laccase and 10-phenothiazine-propionic acid (PPT).

In the method of the invention, the dye is removed by incubation of the dyed fabric with the phenol oxidizing enzyme system and enhancing agent at a temperature of between about 25° C.–120° C. In a more specific embodiment, the incubation is for a time period of between 2–60 min.

In a preferred embodiment, the method comprises incubating indigo dyed denim with a phenol oxidizing enzyme system and enhancing agent for a time period of between 5 min to 3 hours and at a temperature of between about 20° C. to 100° C. In a specific embodiment, the phenol oxidizing enzyme system and enhancing agent is comprised of a solution of laccase and 10-phenothiazine-propionic acid. In a further embodiment, the solution is a paste.

Further embodiments include the step of washing the incubated fabric in the presence of a source of hydrogen peroxide. Suitable sources of hydrogen peroxide include perborate, percarbonate, peroxide, or carbonate. The washing is conducted for between 2–60 min at a temperature of between 25° C.–100° C.

The washed fabric may further be extracted by methods known in the art, as described below.

In a related aspect, the invention is a method for enzymatic discharge printing, comprising the steps of:

(a) contacting a dyed fabric substrate with a phenol oxidizing enzyme;

(b) contacting the enzyme-containing fabric substrate of step (a) with an enhancing agent under conditions in which dye is removed from the surface of the fabric.

In another related aspect, the invention is a method for enzymatic discharge printing, comprising the steps of:

(a) contacting the enzyme-containing fabric substrate of step (a) with an enhancing agent (b) contacting a dyed fabric substrate with a phenol oxidizing enzyme, under conditions in which dye is removed from the surface of the fabric.

One objective of the method of the invention is the ability to separately apply a component of the printing method, such that dye discharge can be initiated at a desired time and/or under desired conditions.

Another object is to provide a printing method which does not damage the substrate or fabric. Use of the enzyme/agent system results in minimal damage to a dyed fabric because of the specificity of the enzymatic reaction for dye molecules. Cellulose or other fibrous substrates are not affected by enzyme application or by the presence of residual amounts of the enzyme and/or enhancer agent if these are not removed immediately.

Another object of the invention is to provide a method of decoloring specific dyes without decoloring other dyes in the same substrate or fabric. By only affecting selected dyes, unique printing shades can be imparted to a fabric when substrates are dyed with a combination of affected and non-affected dyes, e.g., indigo and sulfur black dyed warp yarns in denim fabrics.

The method of the invention provides several advantages, including an improved method of discharge printing. An improved quality of printing can be achieved because it is no longer necessary to combine the dye discharge components under the appropriate reaction conditions.

The enzymatic method of the invention can decolor selected fabric areas to a full range of possible shades through manipulation of the substrate, application, and processing conditions. The method of the invention can be controlled such that only decolorization occurs in areas where the enzyme and enhancer agent are allowed to react, and only under the appropriate reaction conditions.

Other aspects, features, and advantages of the invention will become apparent from the following detailed description, and the claims.

DETAILED DESCRIPTION

Before the methods and compositions of the present invention are described and disclosed it is to be understood that this invention is not limited to the particular methods and compositions described as such may, of course, vary. It is also to be understood that the terminology used herein is for the purpose of describing particular embodiments only, and is not intended to be limiting since the scope of the present invention will be limited only by the appended claims.

It must be noted that as used in this specification and the appended claims, the singular forms "a", "an" and "the" include plural referents unless the context clearly dictates otherwise. Thus, for example, reference to "a color" includes a plurality of colors.

Unless defined otherwise all technical and scientific terms used herein have the same meaning as commonly understood by one of ordinary skill in the art to which this invention belongs. Although any materials or methods similar or equivalent to those described herein can be used in the practice or testing of the present invention, the preferred methods and materials are now described. All publications mentioned herein are incorporated herein by reference for the purpose of describing and disclosing the particular information for which the publication was cited. The publications discussed above are provided solely for their disclosure prior to the filing date of the present application. Nothing herein is to be construed as an admission that the inventor is not entitled to antedate such disclosure by virtue of prior invention.

Enzymatic Discharge Printing of Dyed Textiles

The instant invention is a method for enzymatic discharge printing of a dyed fabric. Specifically, dye on the surface of a dyed fabric is decolored in selected areas to create a printed surface. The method of the invention may also be used in the air brushing of dyed fabrics, particularly of indigo-dyed denim fabrics. However, the method of the invention can be used with non-denim fabrics as well.

Dyed Substrate or Fabric

The method of the invention may be used with a variety of fabrics, including a cellulosic fabric, a mixture of cellulosic fibres, or a mixture of cellulosic fibres and synthetic fibres. The process of the invention is beneficially applied to cellulose-containing fabrics, such as cotton, viscose, rayon, ramie, linen, Tencel, or mixtures thereof, or mixtures of any of these fibres, or mixtures of any of these fibres together with synthetic fibres such as mixtures of cotton and spandex (stretch-denim). In a preferred embodiment, the fabric is denim.

The process of the invention can also be applied to other natural materials such as silk and wool, and to synthetic materials, as well as to mixtures of natural and synthetic materials.

The fabric may be dyed with a variety of dyes and colorants known to the art. The major classes of dyes are azo (mono-, di-, tri-, etc.), carbonyl (anthraquinone and indigo derivatives), cyanine, di- and triphenylmethane and phthalocyanine. Examples of azo compounds are Acid Red 151, Direct Blue 1, Direct Brown 44, Orange II, and Acid Blue 45. In more specific embodiments, the fabric may be dyed with one or more sulphur dyes or vat dyes such as indigo, or indigo-related dyes such as thioindigo. In a preferred embodiment, the fabric is indigo-dyed denim, including clothing items manufactured therefrom. Dyes and colorants are described in PCT publication PCT/DK95/00384, the text of which publication is herein specifically incorporated by reference.

Phenol Oxidizing Enzyme Systems

By the term "a phenol oxidizing enzyme system" is meant a system in which an enzyme, by using hydrogen peroxide or molecular oxygen, is capable of oxidizing organic compounds containing phenolic groups. Examples of such enzymes are peroxidases and oxidases.

If the phenol oxidizing enzyme system requires a source of hydrogen peroxide, the source may be hydrogen peroxide or a hydrogen peroxide precursor for in situ production of hydrogen peroxide, e.g. percarbonate or perborate, or a hydrogen peroxide generating enzyme system, e.g. an oxidase and a substrate for the oxidase, or an amino acid oxidase and a suitable amino acid, or a peroxycarboxylic acid or a salt thereof. Hydrogen peroxide may be added at the beginning of or during the process, e.g. in a concentration corresponding to 0.001–25 mM $H_2O_2$.

If the phenol oxidizing enzyme system requires molecular oxygen, molecular oxygen from the atmosphere will be present in sufficient quantity. Otherwise, oxygen may be supplied as pressurized atmospheric air or as pressurized oxygen.

The enzyme of the phenol oxidizing enzyme systems may be an enzyme exhibiting peroxidase activity or a laccase or a laccase related enzyme as described below.

According to the invention the concentration of the phenol oxidizing enzyme in the localized area in which dye removal is taking place, may be 0.001–10,000 $\mu$g of enzyme protein per g denim, preferably 0.01–1000 $\mu$g of enzyme protein per g denim, more preferably 0.1–100 $\mu$g of enzyme protein per g denim.

Peroxidases and Compounds Possessing Peroxidase Activity

Compounds possessing peroxidase activity may be any peroxidase enzyme comprised by the enzyme classification (EC 1.11.1.7), or any fragment derived therefrom, exhibiting peroxidase activity, or synthetic or semisynthetic derivatives thereof (e.g. porphyrin ring systems or microperoxidases, cf. e.g. U.S. Pat. No. 4,077,768, EP 537,381, WO 91/05858 and WO 92/16634).

Preferably, the peroxidase employed in the method of the invention is producible by plants (e.g. horseradish or soybean peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldarionyces fumago, Ulocladium chartarum, Embellisia alli* or *Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or Trametes (previously called Potyporus), e.g. *T. versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. verticillium.

Other preferred bacteria include *Bacillus pumilus* (ATCC 12905), *Bacillus stearothennophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens.*

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a recombinantly produced peroxidase is a peroxidase derived from a Coprinus sp., in particular *C. macrorhizus* or *C. cinereus* according to WO 92/16634, or a variant thereof, e.g., a variant as described in WO 94/12621.

In the context of this invention, peroxidase acting compounds comprise peroxidase active fragments derived from cytochromes, haemoglobin or peroxidase enzymes, and synthetic or semisynthetic derivatives thereof, e.g. iron porphins, iron porphyrins, and iron phthalocyanine and derivatives thereof.

One source of hydrogen peroxide includes precursors of hydrogen peroxide,e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase and cholesterol oxidase.

Determination of peroxidase activity: 1 peroxidase unit (PODU) is the amount of enzyme that catalyzes the conversion of 1 μmol hydrogen peroxide per minute at the following analytical conditions: 0.88 mM hydrogen peroxide, 1.67 mM 2,2'-azinobis(3-ethylbenzothiazoline-6-sulfonate), 0.1 M phosphate buffer, pH 7.0, incubated at 30° C., photometrically followed at 418 nm.

Laccase and Laccase Related Enzymes

In the context of this invention, laccases and laccase related enzymes contemplate any laccase enzyme comprised by the enzyme classification (EC 1.10.3.2), any chatechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1).

The laccase enzymes are known from microbial and plant origin. The microbial laccase enzyme may be derived from bacteria or fungi (including filamentous fungi and yeasts) and suitable examples include a laccase derivable from a strain of Aspergillus, Neurospora, e.g. *N. crassa*, Podospora, Botrytis, Collybia, Fomes, Lentinus, Pleurotus, Trametes (previously called Polyporus), e.g. *T. villosa* and *T. versicolor*, Rhizoctonia, e.g. *R. solani*, Coprinus, e.g. *C. plicatilis* and *C. cinereus*, Psatyrella, Myceliophthora, e.g. *M. thermophila*, Schytalidium, Phlebia, e.g., *P. radita* (WO 92/01046), or Coriolus, e.g. *C.hirsutus* (JP 2-238885).

The laccase or the laccase related enzyme may furthermore be one which is producible by a method comprising cultivating a host cell transformed with a recombinant DNA vector which carries a DNA sequence encoding said laccase as well as DNA sequences encoding functions permitting the expression of the DNA sequence encoding the laccase, in a culture medium under conditions permitting the expression of the laccase enzyme, and recovering the laccase from the culture.

Determination of Laccase Activity (LACU): Laccase activity is determined from the oxidation of syringaldazin under aerobic conditions. The violet color produced is photometered at 530 nm. The analytical conditions are 19 μM syringaldazin, 23.2 mM acetate buffer, pH 5.5, 30° C., 1 min. reaction time.

1 laccase unit (LACU) is the amount of enzyme that catalyses the conversion ofa 1.0 μmole syringaldazin per minute at these conditions.

Enhancing Agents

Enhancing agent used in the present invention include those known in the art. Generally, the enhancing agent is an organic chemical compound with at least one aromatic ring. In more specific embodiments, the enhancing agent is an organic chemical compound consisting of at least two aromatic rings, of which aromatic rings at least one ring is substituted with one or more nitrogen, oxygen, and/or sulfur atoms, and which aromatic rings may furthermore be fused rings. Suitable enhancing agents are disclosed in PCT publication PCT/DK93/00395, the text of which publication is specifically incorporated herein by reference. Suitable enhancing agents include substituted phenoles, phenothiazines and phenozanes. In specific embodiments, the enhancing agent useful in the method of the invention is one of 2-(p-aminophenyl)-6-methylbenzothiazole-7-sulfonic acid, N-(4-(dimethylamino)benzylidene)-p-anisidine, 3-methyl-2-benzothiazolinone(4-(dimethylamino)benzylidene) hydrazone, vanillin azine, 4-amino-4'-methoxystilbene, 4,4'-diaminostilbene-2,2'-disulfonic acid, iminostilbene, 4,4'-dihydroxybenzophenone, N-benzylidene-4-biphenylamine, 4,4'-diaminodiphenylamine, 4,4'-dimethoxy-N-methyldiphenylamine, 2,7-diaminofluorene, triphenylamine, 10-methylphenothiazine, 10-phenothiazine-propionic acid, N-hydroxysuccinimide-10-phenothiazine-propionate or 10-ethyl-4-phenothiazine-carboxylic acid, 10-ethylphenothiazine, 10-propylphenothiazine, 10-isopropylphenothiazine, methyl-10-phenothiazinepropionate, 10-phenylphenothiazine, 10-allylphenothiazine, 10-(3-(4-methyl-1-piperazinyl) propyl)phenothiazine, 10-(2-pyrrolidinoethyl) phenothiazine, 2-acetyl-10-methylphenothiazine, 4-carboxy-10-phenothiazine, 10-methylphenoxazine, 10-ethylphenoxazine, 10-phenoxazine-propionic acid, 4-carboxy-10-phenoxazine-propionic acid, 10-(2-hydroxyethyl)phenothiazine, 10-(2-hydroxyethyl) phenoxazine or 10-(3-hydroxypropyl)phenothiazine; benzidine, 3,3'-dimethylbenzidine, 3,3'-dimethoxybenzidine, 3,3',5,5'-tetramethylbenzidine, 4'-hydroxy-4-biphenylcarboxylic acid, or 4,4'-dihydroxybiphenylene; 6-hydroxy-2-naphtoic acid, 7-methoxy-2-naphtol, 7-amino-2-naphthalene sulfonic acid, 5-amino-2-naphthalene sulfonic acid, 1,5-diaminonaphthalene, 7-hydroxy-1,2-naphthimidazole, 5-amino-2-naphthalenesulfonic acid, or 7-methoxy-2-naphtol; acetosyringone, methylsyringate, ethylsyringate, propylsyringate, butylsyringate, hexylsyringate, or octylsyringate. In a preferred embodiment the enhancing agent is 10-phenothiazine-propionic acid.

The enhancing agent of the invention may be present in concentrations of from 0.005–1000 μmole per g denim, preferably 0.05–500 μmole per g denim, more preferably 0.05–100 μmole per g denim.

Method of the Invention

In one method of the invention, dyed fabric is contacted with a phenol oxidizing enzyme system and enhancing agent under conditions in which dye is removed from the fabric. Removing the dye from the fabric in preselected areas of the surface of the fabric results in production of a desired image or print.

The fabric may be dyed with a variety of dyes and colorant agents. In specific embodiments, the fabric may be dyed with two or more different types of dyes or colorants, one of which may be removed by the method of the invention resulting in a printed image formed by the remaining dye(s) or colorant.

Generally, the dyed fabric is incubated with the enzyme system and enhancing agents for a specific incubation time and at a specific incubation temperature. An incubation temperature in the range of about 5 to about 120° C., preferably in the range of about 5 to about 80° C., and more preferably in the range of about 15 to about 70° C., and a pH in the range of about 2.5 to about 12, preferably between about 4 and about 10, more preferably in the range of about 4.0 to about 7.0 or in the range of about 7.0 to about 10.0, can be used. Preferably, a temperature and pH near the temperature and pH optima of the enzyme, respectively, are used. In more specific embodiments of the method of the invention, the dyed fabric is incubated for between 2 min to 3 hours at a temperature of between 20° C. to 100° C. In a batch process method, the incubation may be for between 1–24 hours at a temperature of about 20° C.–50° C.

The method of the present invention may further comprise additional components which promote the image printing process, including ions such as sodium, potassium, calcium and magnesium ions, a polymer such as polyvinylpyrrolidone, polyvinylalcohol, polyaspartate, polyvinylamide, polyethelene oxide, and/or a surfactant.

Examples of such surfactants are anionic surfactants such as carboxylates, for example, a metal carboxylate of a long chain fatty acid; N-acylsarcosinates; mono or diesters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butyl-naphthalene sulphonate;

salts or sulphonated naphthalene-formaldehyde condensates; salts of sulphonated phenolformaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are non-ionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

After dye removal, the fabric may be processed in any of a variety of ways known to those skilled in the art, including but not limited to, post-scouring, washing, extracting, and drying.

Prior to incubation, the dyed fabric may be treated in a variety of ways known to those skilled in the art, including being abraded with a cellulase and/or desizing. Desizing may be conducted by methods known in the art, including chemical or enzymatic means.

EXAMPLES

The following examples are put forth so as to provide those of ordinary skill in the art with a complete disclosure and description of how to make and use various constructs and perform the various methods of the present invention and are not intended to limit the scope of what the inventors regard as their invention. Unless indicated otherwise, parts are parts by weight, temperature is in degrees centigrade, and pressure is at or near atmospheric pressure. Efforts have been made to ensure accuracy with respect to numbers used, (e.g., molecular weights, amounts, particular components, etc.) but some deviations should be accounted for.

Discharge images were produced on dyed fabric using a manual screen printing method. A suitable silk screen design was prepared using a fine-mesh screen and a commercially available photoemulsion kit (Speed ball Photo Emulsion for Screen Printing Kit No. 4533; Hunt Manufacturing Co., Statesville, N.C.). The screen was placed on top of the fabric and weighted or held in place during printing. A commercially available enzyme product for bleaching of dyed textiles, especially denim (DeniLite™, Novo Nordisk A/S) containing laccase and the enhancing agent 10-phenothiazine-propionic acid (PPT) was used in the following examples. DeniLite™ is a commercially available product for bleaching of dyed textile, especially denim, is described in PCT publications WO 96/12845 and WO 96/12846, the text of which publications is herein specifically incorporated by reference. In one method of the invention, the print paste was forced through the silk screen design onto an adjacent piece of fabric, resulting in transfer to the fabric of the pattern on the screen. The degree of dye discharge obtained varied with experimental conditions. The degree of dye discharge may be measured on a Macbeth ColorEye 7000 and is expressed as Delta L*, Delta a*, and Delta b*. Increasing Delta L* corresponds to increasing lightness of the printed design compared to the surrounding dyed fabric. Other methods of measuring the degree of dye discharge may be used, for example, a Minolta Chroma Meter CR (300) (Example 12).

Example 1

Desized, indigo dyed denim fabric (Swift Textiles, Inc., Columbus, Ga.) was pre-wetted with water and placed under a silk screen containing a design. A commercial laccase enzyme/mediator slurry (DeniLite™, Novo Nordisk A/S, Bagsvaerd, DK) was applied to the fabric through the screen. The printed fabric was incubated for 3 hours at 25° C., post-scoured in a UniMac washer/extractor for 5 minutes at 75° C. with 0.5 g/L sodium carbonate and 0.5 g/L sodium percarbonate, rinsed and extracted once with hot water and twice with cold water, and air dried. The printed image area was visually slightly lighter in color than the surrounding unprinted fabric (Delta L*=1.4, Delta a*=−0.4, Delta b*=−1.4).

Example 2

Desized, indigo-sulfur dyed denim fabric (Cone Mills, San Francisco, Calif.) was pre-wetted with water and placed under a silk screen containing a design. A commercial laccase enzyme/mediator slurry (DeniLite™, Novo Nordisk A/S, Bagsvaerd, DK) was applied to the fabric through the screen. The printed fabric was incubated for 3 hours at 25° C., post-scoured in a UniMac washer/extractor for 5 minutes at 75° C. with 0.5 g/L sodium carbonate and 0.5 g/L sodium percarbonate, rinsed and extracted once with hot water and twice with cold water, and air dried. The printed image area was visually slightly lighter in color than the surrounding unprinted fabric (Delta L*=5.1, Delta a*=−1.5, Delta b*=−1.6).

Example 3

Desized, indigo dyed denim fabric (Swift Textiles) was pre-wetted with water and placed under a silk screen containing a design. A commercial laccase enzyme/mediator slurry (DeniLite™) was applied as described above. The printed fabric was incubated in a closed container for 3 hours at 50° C., post-scoured in a UniMac washer/extractor as described above, rinsed and extracted once with hot water and twice with cold water, and air dried. The printed image area was visually lighter in color than the surrounding unprinted fabric, but the image was blurred (Delta L*=10.0, Delta a*=−2.5, Delta b*=−2.8).

Example 4

Desized, indigo-sulfur dyed denim fabric (Burlington Industries, Inc., Greensboro, N.C.) was pre-wetted with water and placed under a silk screen containing a design. A commercial laccase enzyme/mediator slurry (DeniLite™) was applied as described above. The printed fabric was incubated in a closed container for 3 hours at 25° C., followed by 3 minutes at 95° C. The printed fabric was post-scoured in a UniMac washer/extractor as described above, rinsed and extracted once with hot water and twice with cold water, and air dried. The printed image area was visually slightly lighter in color than the surrounding unprinted fabric (Delta L*=3.0, Delta a*=−1.0, Delta b*=−1.2).

Example 5

Desized, indigo dyed denim fabric (Swift Textiles) was abraded with cellulase (Denimax T™, Novo Nordisk A/S) according to manufacturer recommendations (Novo Nordisk Product Sheet B494). The abraded denim was pre-wetted with water and placed under a silk screen containing a design. A commercial laccase enzyme/mediator slurry (DeniLite™) was applied as described above. The printed fabric was incubated in a closed container for 3 hours at 25° C. followed by 15 minutes at 95° C. The printed denim was post-scoured as described above, rinsed and extracted once with hot water and twice with cold water, and air dried. The printed image area was distinctly lighter in color than the surrounding unprinted fabric, but the image was blurred (Delta L*=3.3, Delta a*=−0.5, Delta b*=0.4).

Example 6

Desized, indigo dyed denim fabric (Swift Textiles) was abraded with cellulase (Denimax T™) as described above. The abraded denim was pre-wetted with water and placed under a silk screen containing a design. A commercial laccase enzyme/mediator slurry (DeniLite™) was applied as described above. The printed fabric was incubated in a closed container for 3 hours at 50° C. The printed denim was post-scoured as described above, rinsed and extracted once with hot water and twice with cold water, and air dried. The printed image area was distinctly lighter in color than the surrounding unprinted fabric, but the image was blurred (Delta L*=15.8, Delta a*=−0.9, Delta b*=4.5).

Example 7

Desized, indigo dyed denim fabric (Swift Textiles) was pre-wetted with water and placed under a silk screen containing a design. An aqueous solution of one part carboxymethyl cellulose (CMC 7HF, Lot #88026, Hercules, Hopewell, Va.) mixed with 25 parts DeniLite™ was applied to the fabric through the screen. The printed fabric was incubated in a closed container for 5 minutes at 95° C. The printed denim was post-scoured as described above, rinsed and extracted once with hot water and twice with cold water, and air dried. The printed image area was well defined and lighter in color than the surrounding unprinted fabric (Delta L*=7.2, Delta a*=−2.0, Delta b*=−1.0).

Example 8

Desized, indigo dyed denim fabric (Swift Textiles) was pre-wetted with water and placed under a silk screen containing a design. An aqueous solution of one part carboxymethyl cellulose (CMC 7HF) mixed with 6 parts water and 25 parts DeniLite™ was applied to the fabric through the screen. The printed fabric was incubated in a closed container for 5 minutes at 95° C. The printed denim was post-scoured as described above, rinsed and extracted once with hot water and twice with cold water, and air dried. The printed image area was well defined and lighter in color than the surrounding unprinted fabric (Delta L*=15.6, Delta a*=−3.4, Delta b*=1.0).

Example 9

Desized, indigo dyed denim fabric (Swift Textiles) was abraded with cellulase (Denimax™) according to manufacturer recommendations (Novo Nordisk A/S product sheet B494). The abraded denim was pre-wetted with water and placed under a silk screen containing a design. An aqueous solution of one part carboxymethyl cellulose (CMC 7HF) mixed with 6 parts water and 25 parts DeniLite™ was applied to the fabric through the screen. The printed fabric was incubated in an open container for 5 minutes at 95° C. The printed denim was post-scoured as described above, rinsed and extracted once with hot water and twice with cold water, and air dried. The printed image area was lighter in color than the surrounding unprinted fabric, but the image was blurry (Delta L*=11.1, Delta a*=−1.3, Delta b*=2.5).

Example 10

Desized, indigo dyed denim fabric (Swift Textiles) was abraded with cellulase (Denimax T™) as described above. The abraded denim was pre-wetted with water and placed under a silk screen containing a design. An aqueous solution of one part carboxymethyl cellulose (CMC 7HF) mixed with 6 parts water and 25 parts DeniLite™ was applied to the fabric through the screen. The printed fabric was incubated in a closed container for 5 minutes at 95° C. The printed denim was post-scoured, rinsed, extracted, and dried as described above. The printed image area was well defined and distinctly lighter in color than the surrounding unprinted fabric (Delta L*=18.9, Delta a*=−2.0, Delta b*=4.4).

Example 11

Desized, indigo dyed denim fabric (Swift Textiles) was abraded with cellulase (Denimax T™) as described above. The abraded denim was pre-wetted with water and placed under a silk screen containing a design. An aqueous solution of one part carboxymethyl cellulose (CMC 7HF) mixed with 6 parts water and 25 parts DeniLite™ was applied to the fabric through the screen. The printed fabric was incubated in a closed container for 15 minutes at 95° C. The printed denim was processed as described above. The printed image area was very well defined and distinctly lighter in color than the surrounding unprinted fabric. (Delta L*=15.4, Delta a*=−1.4, Delta b*=5.0).

Example 12

San Francisco denim (standard sulphur bottom denim; Swift, France) was desized with Aquazyme 120 L (Novo Nordisk A/S) and abraded with Denimax T™ as described above to a suitable degree of abrasion.

The fabric was screen printed the following way: A conventional silk screen apparatus was used. A silk screen is a metal frame that has a fine synthetic mesh stretched across it. The image was transferred to the screen by using light sensitive emulsion and a negative film or stencil. The fabric was pinned down on to the print table, the screen placed on top of the fabric and weighted or held in place during printing. DeniLite™ is poured on to the screen in an amount that varies with the size of the image as wells as with the intended degree of bleaching/printing.

The printed samples was allowed to partly dry naturally for approximately 15 minutes. The damp sample is then submerged in 2 gallons of still, cold water for at least twenty minutes. During this period care was taken not to disturb the enzyme that has been printed onto the fabric as the slurry must remain on the surface of the fabric for the image to develop. The degree of bleaching can be checked at any stage by scraping off small area of the enzyme. Maximum submersion was fifty minutes.

Once the desired bleaching has been reached the samples was carefully rinsed under cold running water and then allowed to dry (a fan heater may be used).

Depending of the amount of DeniLite™ applied and the time allowed for the image to develop, different degrees of bleaching can be reached. The following differences in L*a*b* values between the printed image and the surrounding fabric after printing were achieved: $\Delta L^*=20.90$, $\Delta a^*=-0.76$, $\Delta b^*=11.27$.

What is claimed is:

1. A method for enzymatic discharge printing, comprising contacting one or more selected areas of the surface of a dyed fabric substrate with a solution comprising a phenol oxidizing enzyme system, an enhancing agent, and a thickening agent, under conditions in which dye is removed from said selected areas.

2. The method of claim 1, wherein the fabric is a cellulosic fabric, a mixture of cellulosic fibres, or a mixture of cellulosic fibres and synthetic fibres.

3. The method of claim 1, wherein the fabric is selected from the group consisting of cotton, cotton denim, polyester, spandex, silk, wool, cellulosic fibers, and mixtures of any of the foregoing.

4. The method of claim 1, wherein the dye is selected from the group consisting of indigo and indigo-related dyes.

5. The method of claim 1, wherein the phenol oxiding enzyme is selected from the group consisting of peroxidase, laccase, chatechol oxidase, bilirubin oxidase, and monophenol monooxygenase.

6. The method of claim 1, wherein the enhancing agent is selected from the group consisting of 2-(p-aminophenyl)-6-methylbenzothiazole-7-sulfonic acid, N-(4-(dimethylamino) benzylidene)-p-anisidine, 3-methyl-2-benzothiazolinone(4-dimethylamino)benzylidene)hydrazone, vanillin azine, 4-amino-4'-methoxystilbene, 4,4'-diaminostilbene-2,2'-disulfonic acid, iminostilbene, 4,4'-dihydroxybenzophenone, N-benzylidene-4-biphenylamine, 4,4'-diaminodiphenylamine, 4,4'-dimethoxy-N-methyldiphenylamine, 2,7-diaminofluorene, triphenylamine, 10-methylphenothiazine, 10-phenothiazine-propionic acid, N-hydroxysuccinimide-10-phenothiazine-propionate, 10-ethyl-4-phenothiozine-carboxylic acid, 10-ethylphenothiazine, 10-propylphenothiazine, 10-isopropylphenothiazine, methyl-10-phenothiazinepropionate, 10-phenylphenothiazine, 10-allylphenothiazine, 10-(3-(4-methyl-1-piperazinyl) propyl)phenothiazine, 10-(2-pyrrolidinoethyl) phenothiazine, 2-acetyl-10-methylphenothiazine, 4-carboxy-10-phenothiazine, 10-methylphenoxazine, 1-ethylphenoxazine, 10-phenoxazine-propionic acid, 4-carboxy-10-phenoxazine-propionic acid, 10-(2-hydroxyethyl)phenothiazine, 10-(2-hydroxyethyl) phenoxazine, 10-(3-hydroxypropyl)phenothiazine, benzidine, 3,3'-dimethylbenzidine, 3,3'-dimethoxybenzidine, 3,3',5,5'-tetramethylbenzidine, 4'-hydroxy-4-biphenylcarboxylic acid, 4,4'-dihydroxybiphenylene, 6-hydroxy-2-napthoic acid, 7-methoxy-2-napthol, 7-amino-2-naphthalene sulfonic acid, 5-amino-2-naphthalene sulfonic acid, 1,5-diaminonaphthalene, 7-hydroxy-1,2-naphthimidazole, 5-amino-2-naphthalenesulfonic acid, 7-methyoxy-2-naphtol, acetosyringone, methylsyringate, ethylsyringate, propylsyringate, butylsyringate, hexylsyringate, and octylsyringate.

7. The method of claim 1, wherein the phenol oxidizing enzyme system comprises peroxidase and a source of hydrogen peroxide.

8. The method of claim 1, wherein the phenol oxidizing enzyme system and enhancing agent comprise laccase and 10-phenothiazine-propionic acid.

9. The method of claim 1, wherein the conditions under which dye is removed comprise incubation at a temperature of between about 25° C.–120° C.

10. The method of claim 9, wherein the incubation is for a time period of between 2–60 min.

11. The method of claim 1, wherein indigo dyed denim is (a) incubated with the solution for a time period of between 5 min to 3 hours and at a temperature of between about 20° C. to 100° C.

12. The method of claim 10, wherein the phenol oxidizing enzyme system and enhancing agent is comprised of a solution of laccase and 10-phenothiazine-propionic acid.

13. The method of claim 11, wherein the phenol oxidizing system and enhancing agent are present in a paste.

14. The method of claim 11, further comprising the step of (b) washing the incubated fabric in the presence of a source of hydrogen peroxide.

15. The method of claim 14, wherein the source of hydrogen peroxide is selected from the group consisting of perborate, percarbonate, peroxide, and carbonate.

16. The method of claim 15, wherein the washing is conducted for between 2–60 min at a temperature of between 25° C.–100° C.

17. The method of claim 14, further comprising the step of (c) extracting the washed fabric.

18. The method of claim 11, wherein prior to incubation the indigo dyed denim is treated by desizing and/or contact with cellulase.

19. A method for enzymatic discharge printing, comprising the steps of:

(a) contacting one or more selected areas of the surface of a dyed fabric substrate with a phenol oxidizing enzyme, and (b) contacting the enzyme-containing fabric substrate of step (a) with an aqueous solution comprising an enhancing agent and a thickening agent under conditions in which dye is removed from said selected areas.

20. A method for enzymatic discharge printing, comprising the steps of:

(a) contacting one or more selected areas of the surface of a dyed fabric substrate with an enhancing agent, and (b) contacting the fabric substrate of step (a) with a solution comprising a phenol oxidizing enzyme and a thickening agent under conditions in which dye is removed from said selected areas.

* * * * *